US005469181A

United States Patent [19]

Yarsunas

[11] Patent Number: 5,469,181

[45] Date of Patent: Nov. 21, 1995

[54] VARIABLE HORIZONTAL BEAMWIDTH ANTENNA HAVING HINGEABLE SIDE REFLECTORS

[75] Inventor: George D. Yarsunas, Vincentown, N.J.

[73] Assignee: Celwave, Marlboro, N.J.

[21] Appl. No.: 210,273

[22] Filed: Mar. 18, 1994

[51] Int. Cl.[6] ..... H01Q 21/12

[52] U.S. Cl. ..... 343/815; 343/820; 343/812; 343/839

[58] Field of Search ..... 343/815, 761, 343/839, 840, 878, 781 P, 781 CA, 915

[56] References Cited

U.S. PATENT DOCUMENTS

| | | | |
|---|---|---|---|
| 2,408,373 | 1/1945 | Chu | 343/839 |
| 2,535,049 | 12/1950 | Derosa | 343/792 |
| 3,882,503 | 5/1975 | Gamara | 343/761 |
| 3,938,162 | 2/1976 | Schmidt | 343/840 |
| 4,253,100 | 2/1981 | Commault et al. | 343/756 |
| 4,314,253 | 2/1982 | Sayovitz | 343/765 |
| 4,529,277 | 7/1985 | Gee et al. | 343/915 |
| 4,535,961 | 8/1985 | Sobczak et al. | 343/765 |
| 4,612,550 | 9/1986 | Brucker et al. | 343/756 |
| 4,646,102 | 2/1987 | Akaeda et al. | 343/915 |
| 4,792,815 | 12/1988 | Moisdon | 343/915 |
| 4,868,578 | 9/1989 | Bruinsma et al. | 343/878 |

*Primary Examiner*—Donald Hajec
*Assistant Examiner*—Tan Ho
*Attorney, Agent, or Firm*—Ware, Fressola, Van Der Sluys & Adolphson

[57] ABSTRACT

The invention provides a broadband directional antenna having a central reflector plate, a dipole and at least one side reflector panel. The dipole is arranged on the central reflector plate for radiating a radio frequency signal, including a binary feed network having a microstrip transmission line and a colinear array of radiating elements. The side reflector panel is hinged to the central reflector plate for adjusting the horizontal radiation beamwidth of the radio frequency signal.

18 Claims, 7 Drawing Sheets

VARIABLE HORIZONTAL BEAMWIDTH ANTENNA HAVING HINGEABLE SIDE REFLECTORS

FIELD OF THE INVENTION

The present invention relates generally to a horizontal beamwidth antenna, and more particularly relates to a variable horizontal beamwidth antenna having hingeable side panel reflectors.

RELATED ART

There are many different types of antennas in the prior art. For example, Commault et al., U.S. Pat. No. 4,253,100 shows an inverse Cassegrain antenna for multiple function radar. As can be seen in FIG. 2, the Commault et al. antenna comprises a primary source S of high frequency electromagnetic waves with linear polarization, a curved primary reflector R for selectively reflecting the linear polarized electromagnetic waves from the primary source, and a polarization rotation mirror M1 positioned around the source in the focus of the primary reflector. The polarization rotation mirror M1 re-reflects the wave coming from the primary reflector, the re-reflection undergoing a rotation in its polarization plane thus being able to pass through primary reflector R.

The polarization rotation mirror M1 has two reflector-polarizer elements e1, e2 joined by a hinge c1 permitting their articulation. FIGS. 5 and 6 and FIGS. 9*a* and 9*b* illustrate similar polarization rotation mirrors having two and three hinge axes respectively. The articulation of the reflector-polarizer elements allows the antenna beamwidth to be controlled thereby making it possible to use the antenna for look-out and tracking functions (using the conventional fine beam) and for anti-collision functions (using a widened beam). Further, the beamwidth can be adjusted in either the elevation or in the bearing plane. Commault et al. does not disclose a hinged primary reflector for controlling the horizontal antenna beamwidth, but rather shows a hinged secondary reflector (i.e., the hinged polarization rotation mirror) for controlling the antenna beamwidth. In column 1, lines 16–18, Commault et al. discusses modification of the shape of simple antennas for controlling beamwidth.

DeRosa, U.S. Pat. No. 2,535,049, discloses an antenna structure having radiating members 6 pivotably mounted to a supporting member 2 at a pivot 4. The movability of the radiating members allows the antenna to be employed at different frequencies while maintaining a given radiation pattern.

Gamara, U.S. Pat. No. 3,882,503, discloses a wave detection apparatus having two relatively movable wave reflecting surfaces 11 and 12. The wave reflecting surfaces 11 and 12 are reciprocated towards an antenna horn 25 at relatively different rates thereby modulating the antenna horn output at different frequencies for vertical movement detection. Gamara does not show an antenna having an adjustable beamwidth.

Gee et al., U.S. Pat. No. 4,529,277, discloses a foldable parabolic reflector for storage on a spacecraft. The foldable reflector does not have an adjustable beamwidth.

Similarly, Akaeda et al., U.S. Pat. No. 4,646,102, discloses a deployable antenna reflector apparatus which comprises a foldable parabolic antenna reflector for storage on a spacecraft.

Moisdon, U.S. Pat. No. 4,792,815, discloses a reception system for satellite signals comprising a parabolic reflector having a plurality of parabolic petals. The parabolic petals may be selectively moved so that they overlay one another for controlling amplification of the received satellite signal. Moisdon does not disclose an antenna having an adjustable beamwidth.

SUMMARY OF THE INVENTION

The invention features an antenna comprising a central reflector plate, a dipole assembly arranged thereon for radiating a radio frequency signal; and a pair of side reflectors being hinged to said central reflector plate for adjusting the horizontal radiation beamwidth of the radio frequency signal.

Accordingly, a principal object of the present invention is to provide an antenna for radiating a radio frequency signal having a desired horizontal and vertical radiation pattern depending of the application.

A principal advantage of the present invention is to provide an antenna having hingeable side reflectors which can be adjusted to a plurality of settings.

Other objects of the invention will in part be obvious and will in part appear hereinafter.

The invention accordingly comprises the features of construction, combination of elements, and arrangement of parts which will be exemplified in the construction hereinafter set forth, and the scope of the invention will be indicated in the claims.

A DESCRIPTION OF THE DRAWING

For a fuller understanding of the nature and objects of the invention, reference should be made to the following detailed description taken in connection with the accompanying drawings, in which.

Figure 4:
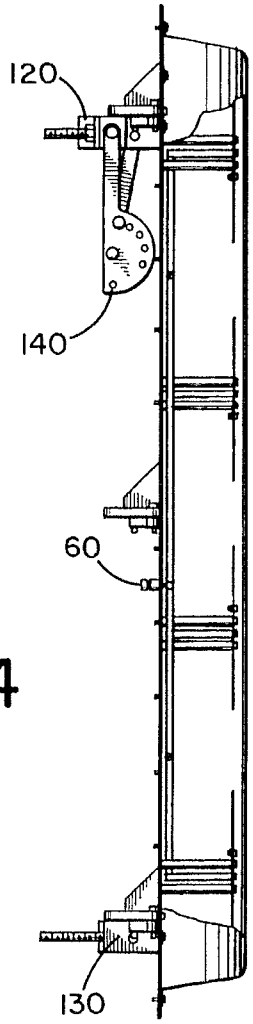
FIG. 4 is a side view of the antenna in FIG. 1 along lines 4—4.
Figure 5A:
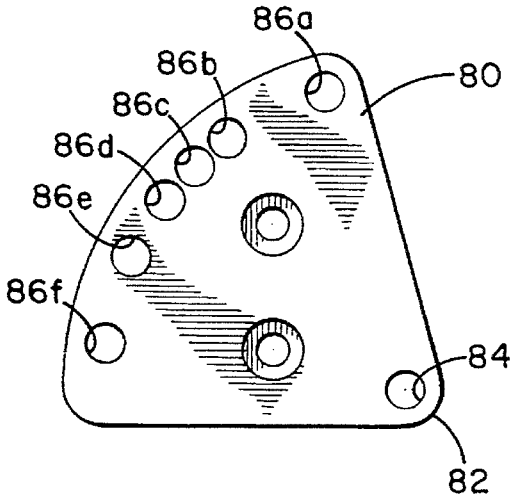
Figure 5B:
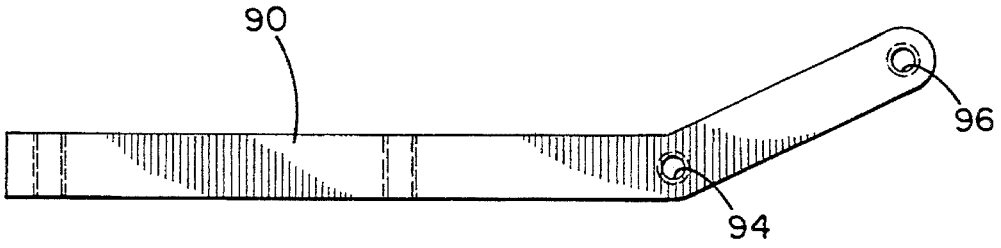
Figure 5C:
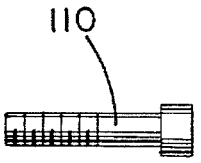

FIGS. 5*a*, 5*b* and 5*c* show a lower hinge 24L of the antenna in FIG. 4.

Figure 6B:
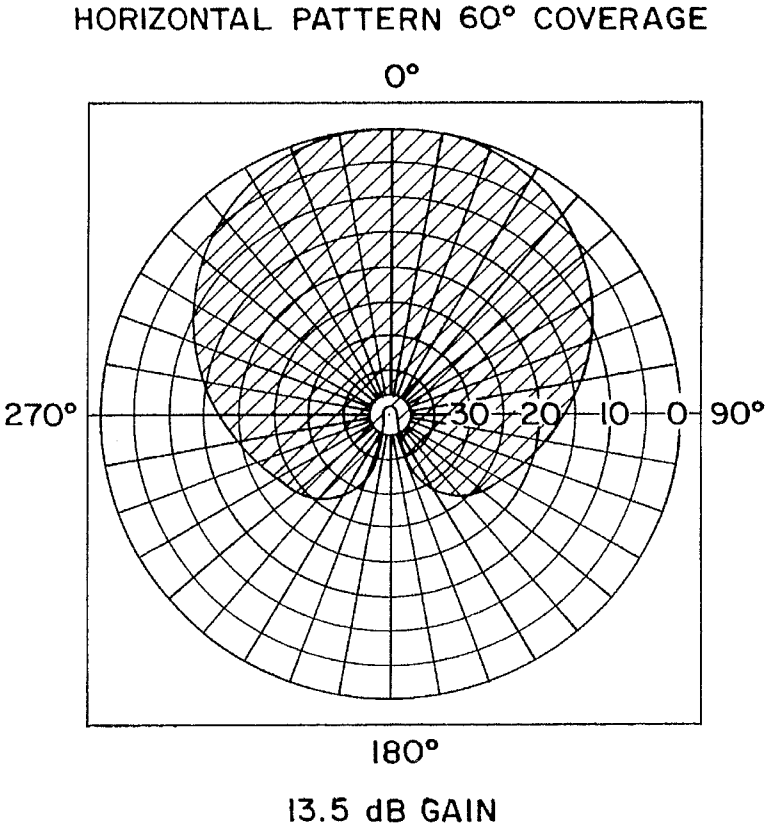
Figure 6A:
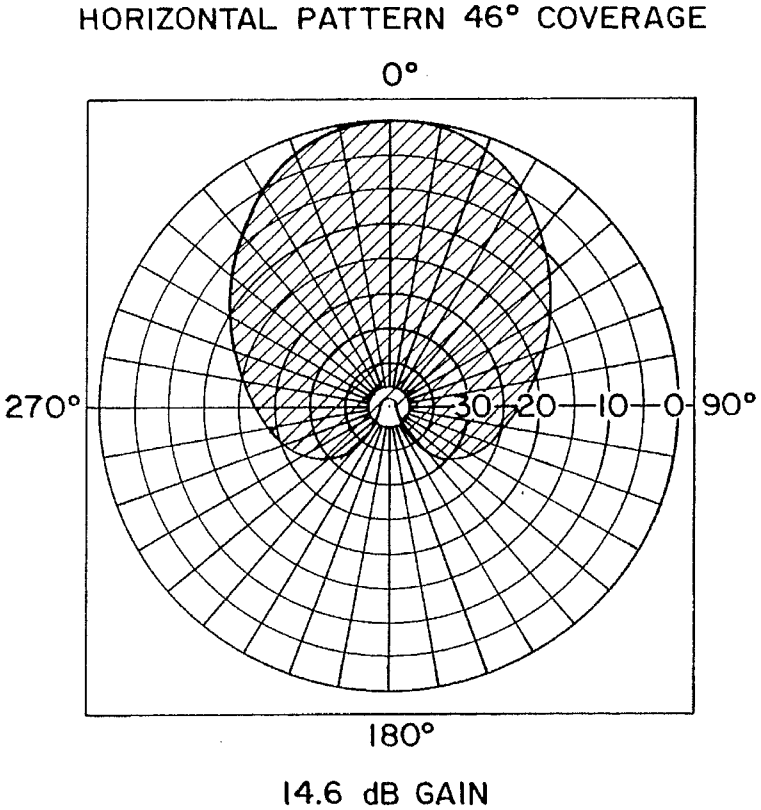

FIG. 6*a* is a horizontal radiation pattern having 46° coverage and 14.6 dB.

FIG. 6*b* is a horizontal radiation pattern having 60° coverage and 13.5 dB.

Figure 6D:
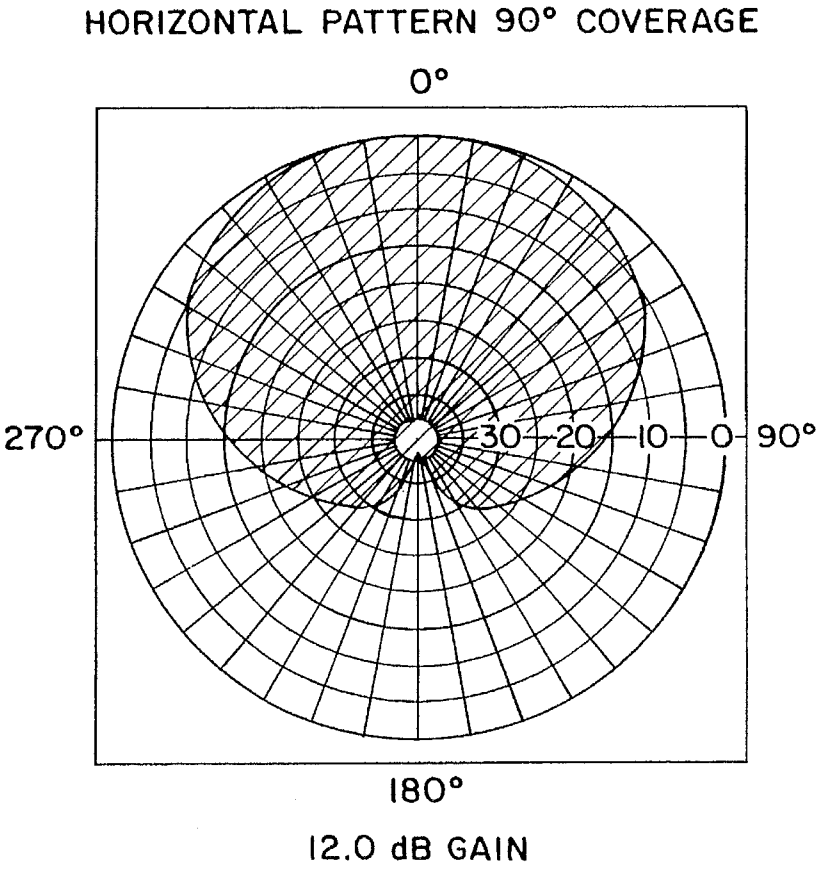
Figure 6C:
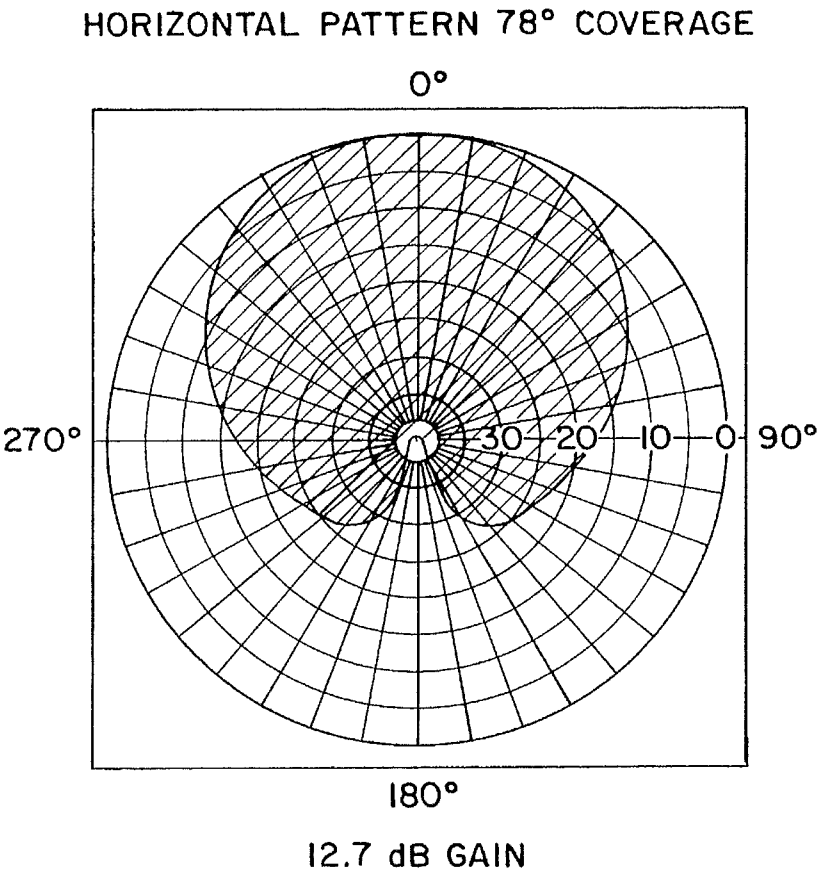

FIG. 6*c* is a horizontal radiation pattern having 78° coverage and 12.7 dB.

FIG. 6*d* is a horizontal radiation pattern having 90° coverage and 12.0 dB.

Figure 6F:
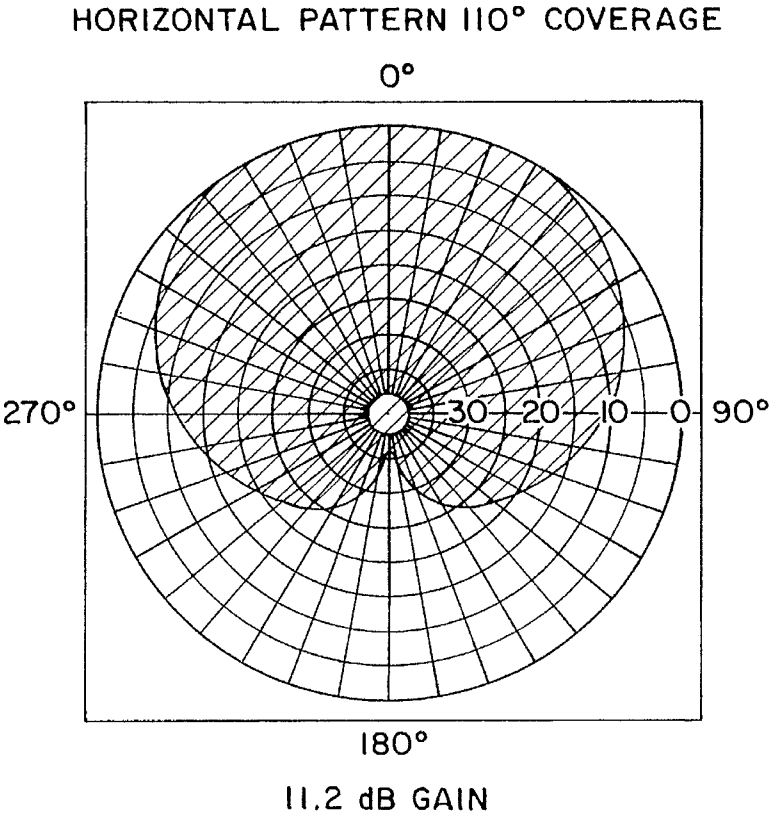
Figure 6E:
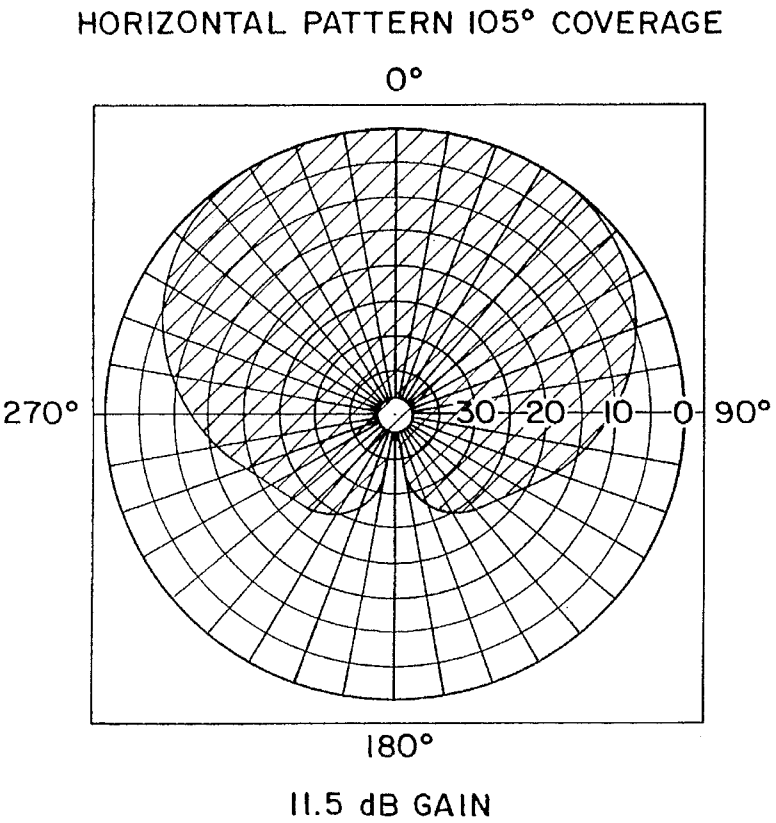

FIG. 6*e* is a horizontal radiation pattern having 105° coverage and 11.5 dB.

FIG. 6*f* is a horizontal radiation pattern having 110° coverage and 11.2 dB.

Figure 6G:
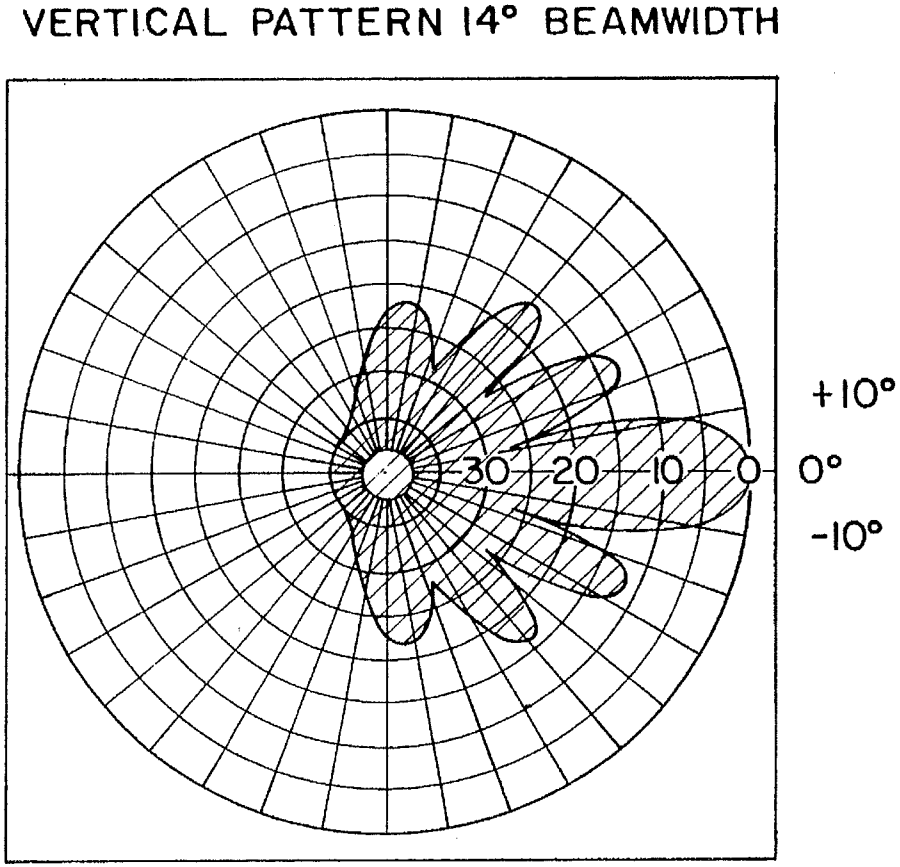

FIG. 6*g* is a vertical radiation pattern having a 14° beamwidth.

BEST MODE FOR CARRYING OUT THE INVENTION

Figure 1:
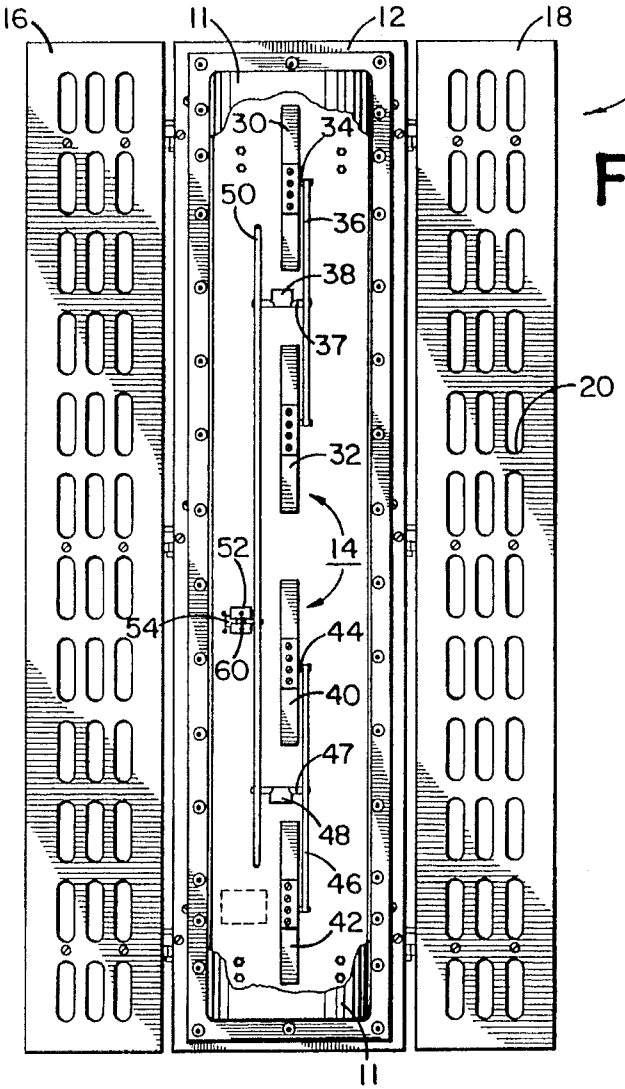
FIG. 1 is a front view of the antenna of the present invention.

FIG. 1 shows a variable H sector panel antenna 10 having a central reflector plate 12 and a dipole assembly means 14 arranged thereon for radiating a radio frequency signal. The central reflector plate 12 radiates the radio signal in a given direction. The variable H sector panel antenna 10 also has left and right side reflector plates 16 and 18 respectively as shown which are hinged to the central reflector plate 12 for adjusting the horizontal radiation beamwidth of the radio frequency signal radiated from the antenna 10 as discussed in great detail below. Each side reflector plate 16, 18 has apertures shown as 20 for reducing the wind load on the antenna. The variable H sector panel antenna 10 is covered by a radome which is shown in part as 11.

FIG. 1 shows the dipole assembly means 14, which is described in U.S. Pat. No. 5,274,391 (assigned to the assignee of the instant application and herein incorporated by reference). As shown in FIG. 1 the dipole assembly means 14 has two pair of dipole assemblies including respectively dipoles 30, 32; and 40, 42. The dipoles 30, 32 are connected by conductors 34, 36, 37 and a trim 38 to a central conductor 50. The dipoles 40, 42 are connected by conductors 44, 46, 47 and a trim 48 to the central conductor 50. The central conductor 50 is connected by a trim 52 and a conductor 54 to a connector 60 (see FIG. 4).

Figure 2:
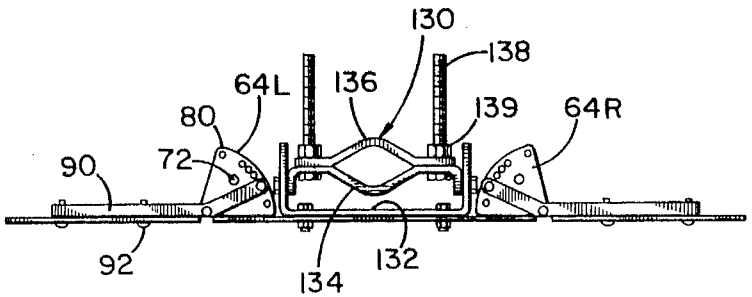
FIG. 2 is a bottom up, cross-sectional view of the antenna in FIG. 1 along lines 2—2.
Figure 3:
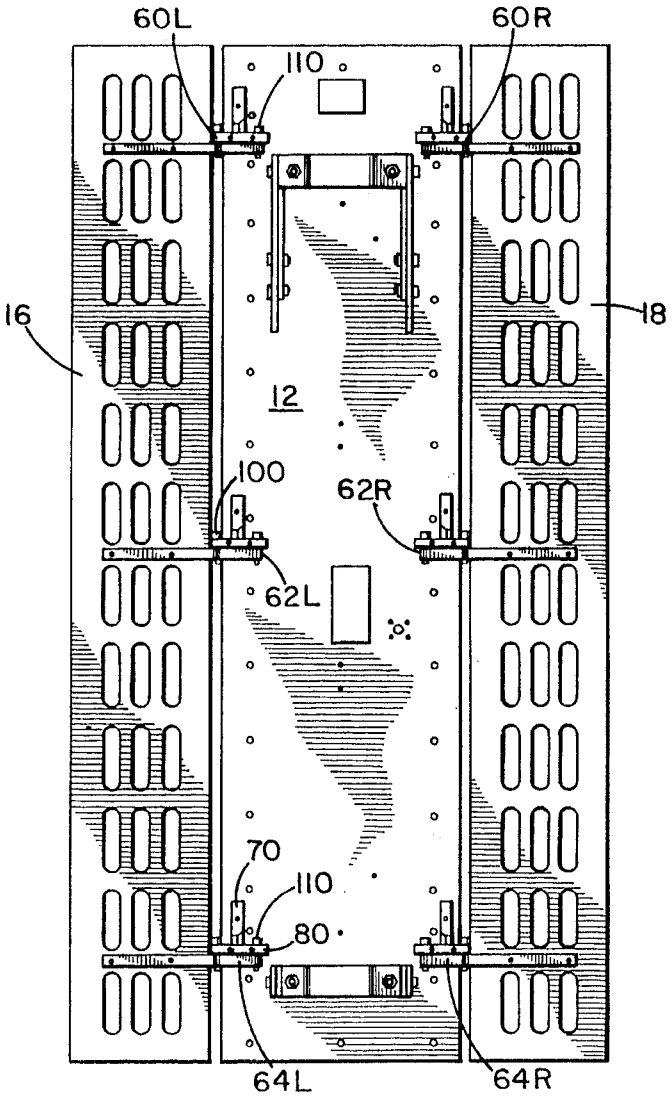
FIG. 3 is a back view of the antenna in FIG. 1.

As shown in FIGS. 2 and 3, each side reflector plate 16, 18 is connected to the central primary reflector plate 12 by left and right upper, intermediate and lower hinges which are respectively generally indicated as 60L, 60R, 62L, 62R, 64L, 64R.

As shown in FIGS. 2 and 3, the left lower hinge 64L includes a vertical support 70 secured to the central reflector plate 12. The vertical support 70 is fixedly connected to a left lower bracket 80 by a screw 72. As shown in FIG. 5*a*, the left lower bracket 80 has a vertex 82 with an opening 84 and has apertures 86 radially arranged thereon.

The left lower hinge 64L also includes a left lower adjustment arm 90 fixedly connected to the left side reflector plate 16 by screws 92 as shown in FIG. 2. As best shown in FIG. 5*b*, the left adjustment arm 90 is shown obtusely angled, having a vertex 92 with an intermediate opening 94, and an end opening 96.

The left bracket 80 is hingedly connected to the left adjustment arm 90 by a screw 100 (FIG. 3) passing through the opening 84 of the left lower bracket 80 and the intermediate opening 94 of the adjustment arm 90 respectively.

In order to set the left side reflector panel 16 with respect to the central reflector plate 12, one of the radially arranged apertures 86 of the left bracket 80 is aligned with the end opening 96 of the left adjustment arm 90. A screw 110 (FIG. 5*c*) is passed therethrough, (see FIG. 3) for locking the left side reflector plate 16 at a predetermined angle with respect to the central reflector plate 12. The screw 110 is secured into the left bracket 80.

The other upper, intermediate and lower hinges 60L, 60R, 62L, 62R, 64R operate in a very similar manner as the left lower hinge 64L. The antenna 10 shown in FIGS. 1–4 includes the upper, intermediate and lower hinges 60L, 60R, 62L, 62R, 64L, 64R, which all include the means for locking each side reflector plates 16, 18 at a predetermined angle with respect to the central reflector plate 12. However, the invention is not intended to be limited in this manner. For instance, an antenna embodiment is possible which includes the upper hinges 60L, 60R and lower hinges 64L, 64R, and in which either but not both hinges 60L, 60R, 64L and 64R include the means for locking each side reflector plate 16, 18 at a predetermined angle with respect to the central reflector plate 12. Of course, the more hinges on the antenna and the more means for locking, the less the antenna will be effected by vibration from the wind. The scope of the invention includes any embodiment having the upper hinges 20L, 20R, the intermediate hinges lower 62L, 62R, the lower hinges 64L, 64R, or a combination thereof, having the means for locking each side reflector plate 16, 18 at a predetermined angle with respect to the central reflector plate 12.

In addition, as also shown in FIGS. 3 and 4, the variable H sector panel antenna 10 also includes an upper bracket 120 and a lower bracket 130 mounted on the rear side of the central reflector plate 12 thereof for fixedly securing the antenna on an object. Either the upper bracket 120 or the lower bracket 130 can include means for tilting the antenna upwardly and downwardly for adjusting the vertical pattern of the radio frequency signal radiated from the antenna 10. As also shown in FIGS. 3 and 4 the upper bracket 120 has means 140 for tilting the antenna 10 upwardly and downwardly.

As shown in FIG. 2, the lower bracket 130 has a bottom bracket portion 132 fixed to the back of the central primary plate 12. The bottom bracket portion 132 has a swivel clamp 134 rotatably arranged therein and a clamp 136 with bolts 138 and nuts 139.

FIGS. 6*a*–6*f* show the horizontal radiation patterns when the side reflector plates 16, 18 are set in the different positions 86*a*, 86*b*, . . . , 86*f* with respect to the central primary reflector plate 12.

In FIG. 6*a*, the side reflector plates 16, 18 are in position 86*a* (FIG. 5*a*) for providing a radio frequency having a horizontal radiation pattern with a 46° coverage and a 14.6 dB gain. The horizontal beamwidth is determined from the angle between the –3 dB points (half power) on both sides of the beam maximum. The antenna gain is the signal increase over a dipole antenna.

If the side reflector plates 16, 18 are in position 86*b* (FIG. 5*a*), then the antenna radiates a radio frequency having a horizontal radiation pattern with a 60° coverage and a 13.5 dB gain as shown in FIG. 6*b*.

If the side reflector plates 16, 18 are in position 86*c* (FIG. 5*a*), then the antenna radiates a radio frequency having a horizontal radiation pattern with a 78° coverage and a 12.7 dB gain as shown in FIG. 6*c*.

If the side reflector plates 16, 18 are in position 86*d* (FIG. 5*a*), then radiates a radio frequency having a horizontal radiation pattern with a 90° coverage and a 12.0 dB gain as shown in FIG. 6*d*.

If the side reflector plates 16, 18 are in position e (FIG. 5*a*), then the antenna radiates a radio frequency having a horizontal radiation pattern with a 105° coverage and a 11.5 dB gain as shown in FIG. 6*e*.

If the side reflector plates 16, 18 are in position 86*f* (FIG. 5*a*), then the antenna radiates a radio frequency having a horizontal radiation pattern with a 110° coverage and a 11.2 dB gain as shown in FIG. 6*f*.

For each of the horizontal radiation patterns shown in FIGS. 6*a*–6*f*, the antenna 10 has a vertical beamwidth of 14 degrees as shown in FIG. 6*g*.

It will thus be seen that the objects set forth above, and those made apparent from the preceding description, are efficiently attained and, since certain changes may be made in the above construction without departing from the scope of the invention, it is intended that all matter contained in the above description or shown in the accompanying drawings shall be interpreted as illustrative and not in a limiting sense.

It is also to be understood that the following claims are intended to cover all of the generic and specific features of the invention herein described and all statements of the scope of the invention which, as a matter of language, might be said to fall therebetween.

What is claimed is:

1. A broadband directional antenna comprising:

a) a flat central reflector plate;

b) dipole means arranged on said central reflector plate for radiating a radio frequency signal, including a binary feed network having a microstrip transmission line and a colinear array of radiating elements; and c) at least one flat side reflector plate being hinged to said central reflector plate for adjusting the horizontal radiation beamwidth of the radio frequency signal.

2. An antenna according to claim 1, wherein each side reflector plate has a plurality of apertures for reducing the wind load on the antenna.

3. An antenna according to claim 1, wherein each side reflector plate is connected to said central reflector plate by a respective upper hinge and a respective lower hinge.

4. An antenna according to claim 1, wherein each side reflector plate is also connected to said central reflector plate by an intermediate hinge arranged between the upper and lower hinges.

5. An antenna according to claim 3, wherein each lower hinge has a locking means for securing the side reflector plate at a predetermined angle with respect to the central reflector plate.

6. An antenna according to claim 5, wherein the locking means includes a bracket affixed to the central reflector plate having a plurality of radially arranged apertures, an adjustment arm affixed on the side reflector plate having an end opening, and a fastening means for sliding through one of the radially arranged apertures of the bracket and the end opening of the adjustment arm when aligned in registration with each other.

7. An antenna according to claim 1, wherein said central reflector plate includes an upper mounting bracket and a lower mounting bracket on the rear side thereof for securing the antenna on an object.

8. An antenna according to claim 1, wherein the means for radiating includes a dipole assembly means having two pair of dipole assembly.

9. A broadband directional variable H sector panel antenna, comprising:

a) a flat central reflector plate;

b) a dipole assembly arranged thereon for radiating a radio frequency signal, including a binary feed network having a microstrip transmission line and a colinear array of radiating elements; and c) a pair of secondary flat side reflector plates being hinged to said central reflector plate for varying the horizontal radiation beamwidth of the radio frequency signal.

10. A variable H sector panel antenna according to claim 9, wherein each side reflector plate has a plurality of apertures for reducing the wind load on the antenna.

11. A variable H sector panel antenna according to claim 9, wherein each side reflector plate is connected to said central reflector plate by a respective upper hinge and a respective lower hinge.

12. A variable H sector panel antenna according to claim 11, wherein each secondary side reflector plate is also connected to said central reflector plate by an intermediate hinge arranged between the upper and lower hinges.

13. A variable H sector panel antenna according to claim 11, wherein each lower hinge has a locking means for securing the secondary side reflector plate at a predetermined angle with respect to the central reflector plate.

14. A variable H sector panel antenna according to claim 13, wherein the locking means includes a bracket affixed to the central reflector plate having a plurality of radially arranged apertures, an adjustment arm affixed on the side reflector plate having an end opening, and a fastening means for sliding through one of the radially arranged apertures of the bracket and the end opening of the adjustment arm when aligned in registration with each other.

15. A variable H sector panel antenna according to claim 9, wherein said central reflector plate includes an upper mounting bracket and a lower mounting bracket on the rear side thereof for securing the antenna on an object.

16. A variable H sector panel antenna according to claim 9, wherein the dipole assembly means includes two pair of dipole assembly, each pair being connected by a central conductor to an input connector.

17. A variable H sector panel antenna according to claim 9, wherein said pair of secondary side reflector plate have a first position for radiating a first corresponding radio frequency signal having a horizontal radiation pattern with a 46° coverage and a 14.6 dB gain, a second position for providing a second corresponding radio frequency signal having a horizontal radiation pattern with a 60° coverage and a 13.5 dB gain, a third position for providing a third corresponding radio frequency signal having a horizontal radiation pattern with a 78° coverage and a 12.7 dB gain, a fourth position for providing a fourth corresponding radio frequency signal having a horizontal pattern with a 90° coverage and a 12.0 dB gain, a fifth position for providing a fifth corresponding radio frequency signal having a horizontal radiation pattern with a 105° coverage and a 11.5 dB gain, a sixth position for providing a sixth corresponding radio frequency signal having a horizontal pattern with a 110° coverage and a 11.2 dB gain.

18. A variable H sector panel antenna according to claim 17, wherein the antenna has a radiating radio frequency signal having a vertical radiation pattern with a 14° beamwidth.

* * * * *